US005150898A

United States Patent [19]

Hochberg et al.

[11] Patent Number: 5,150,898

[45] Date of Patent: Sep. 29, 1992

[54] GAME APPARATUS

[75] Inventors: Joel Hochberg, Miami, Fla.; Timothy D. J. Stamper, Ravenstone; Christopher T. J. Stamper, Twycross Warks, both of England

[73] Assignee: Rare Coin-It, Inc., Miami, Fla.

[21] Appl. No.: 653,253

[22] Filed: Feb. 11, 1991

[51] Int. Cl.[5] ..... A63F 7/20

[52] U.S. Cl. ..... 273/85 C; 273/85 E; 273/119 A; 273/127 R; 273/359; 273/369

[58] Field of Search ..... 273/1.5 R, 1.5 A, 85 C-85 E, 273/57.2, 340, 348, 359, 366-370, 406, 407, 127 R, 108-117, 177 R, 85 R, 181 R; 434/20, 23, 24

[56] References Cited

U.S. PATENT DOCUMENTS

| | | | |
|---|---|---|---|
| 2,421,220 | 5/1947 | Robinson | 273/1.5 R X |
| 2,658,495 | 11/1953 | Elliott | 273/1.5 R X |
| 2,734,745 | 2/1956 | Tarte | 273/368 X |
| 2,735,682 | 2/1956 | Sweet | 273/85 |
| 2,886,321 | 5/1959 | Tarte | 273/368 |
| 2,893,734 | 7/1959 | Tarte, Jr. | 273/85 |
| 3,063,161 | 11/1962 | Baranoff | 434/23 X |
| 3,531,120 | 9/1970 | Ross et al. | 273/370 |
| 3,610,623 | 10/1971 | Ferrer | 273/368 |
| 3,865,373 | 2/1975 | Knight | 273/406 X |
| 3,958,806 | 5/1976 | Brown | 273/1.5 R X |
| 4,013,292 | 3/1977 | Cohen et al. . | |
| 4,088,322 | 5/1978 | Nikoden | 273/406 |
| 4,109,914 | 8/1978 | Matsumoto | 273/367 X |
| 4,177,992 | 12/1979 | Todokoro | 273/406 X |
| 4,239,214 | 12/1980 | Brenner | 273/1.5 R |
| 4,496,160 | 1/1985 | Wichinsky et al. | 273/369 |
| 4,858,920 | 8/1989 | Best | 273/371 X |
| 5,035,423 | 7/1991 | Arciniega | 273/1.5 A |

*Primary Examiner*—Benjamin H. Layno
*Assistant Examiner*—Sebastiano Passaniti
*Attorney, Agent, or Firm*—Christensen, O'Connor, Johnson & Kindness

[57] ABSTRACT

A game apparatus (10) including a projectile propeller (12) mounted on a forward end portion (14) of a housing (16). The game apparatus further includes a target (18) mounted to translate forwardly and rearwardly with respect to the projectile propeller adjacent a rearward end portion (20) of the housing. The projectile propeller is operable to propel a game projectile (22) towards the target (18) with a varying trajectory relative to the translational position of the target.

17 Claims, 4 Drawing Sheets

GAME APPARATUS

TECHNICAL FIELD OF THE INVENTION

The present invention relates to a game apparatus, and more particularly to a game apparatus for propelling a game projectile towards a forwardly and rearwardly translating target.

BACKGROUND OF THE INVENTION

Game apparatus configured to simulate the play of sports games, and test a player's skill and accuracy, are well known and popular. One type of apparatus simulates the playing of a basketball game and requires the player to launch a ball into a basket. One such conventional apparatus is a table top basketball game disclosed by U.S. Pat. No. 2,735,682 to Sweet. The game is played by two players, each flipping balls with a lever toward an opposing basket. The location of the opposing basket may be changed between games by adjusting a screw that secures the basket a selected position relative to the shooting lever. However, the disclosed game apparatus does not provide for a continuous or automated adjustment of the distance between the ball launching lever and the opposing basket during the play of the game.

Another conventional apparatus is disclosed by U.S. Pat. No. 4,496,160 to Wichinsky et al. The disclosed arcade-style game provides a number of laterally spaced coin slots into which a coin may be inserted. The inserted coin is then hurled towards a backboard containing a number of baskets. The backboard includes one basket that is mounted to automatically translate from side to side during the course of the game. While this transverse translation of the basket does cause a user to choose the optimum coin slot into which to place a coin, it does not affect the change in the distance between the coin launching platform and the basket.

Conventional game apparatus do not enable a player to continuously gauge a changing distance between a projectile propeller and a target, and adjust the projectile trajectory accordingly. Thus, conventional apparatus do not develop the gauging/adjustment skills required for live sports.

SUMMARY OF THE INVENTION

The present invention provides a game apparatus including a mechanism mounted on a first end portion of a housing for selectively propelling a game projectile towards a target. The target is mounted adjacent a second end portion of the housing to automatically translate towards and away from the first end portion of the housing to vary the distance between the projectile propeller and the target.

In the preferred embodiment of the present invention, the game apparatus is configured as a table top basketball game. The game includes a catapult propeller mounted on a first end of a housing. The game further includes a basket mounted to a carriage that includes a pin projecting downwardly through a longitudinal slot formed through a second end portion of the housing. The game includes a motor mounted within the housing and coupled by a gear transmission to a rotating bellcrank and link to the carriage pin. Rotation of the motor results in translation of the carriage forwardly and rearwardly along the slot with respect to the catapult ball launcher. Thus the distance between the catapult propeller and the basket varies throughout play of the game. A player must gauge the distance between the ball and the basket at any point in time and adjust the trajectory of the ball accordingly in order to attempt to land the ball in the basket.

In a further aspect of the present invention, the mechanism connecting the backboard to the motor causes the backboard to delay in its translating movement at the points where it is closest and furthest from the propeller device, thus adding further challenge to the user in calculating the position of the backboard.

In a still further aspect of the present invention, the catapult propeller is mounted to enable manual sliding from side to side so that the position of the catapult can be controlled to accurately launch balls towards the basket.

In a further aspect of the present invention, the game apparatus includes means for monitoring of elapsed game time and the number of balls landing in the basket, and displaying this information on a display.

BRIEF DESCRIPTION OF THE DRAWINGS

The present invention will be readily understood by those of ordinary skill in the art upon reading the following specification in conjunction with the appended drawings, in which.

DETAILED DESCRIPTION OF THE PREFERRED EMBODIMENT

Figure 1:
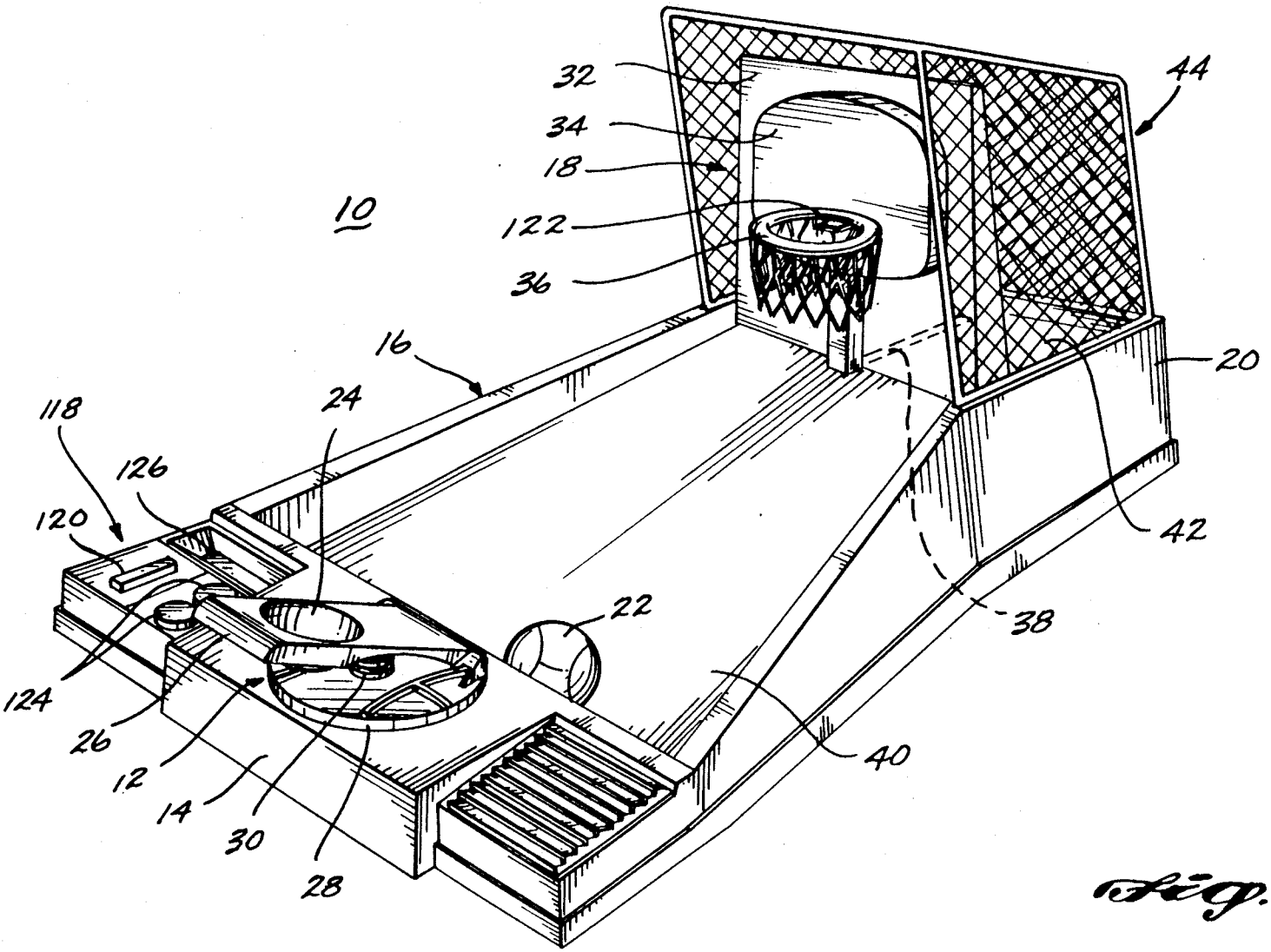
FIG. 1 shows a pictorial view of a game apparatus constructed in accordance with the present invention.

A preferred embodiment of a game apparatus 10 constructed in accordance with the present invention is illustrated in FIG. 1. The game apparatus includes a projectile propeller 12 mounted on a first, forward end portion 14 of a housing 16. The game further includes a target 18 mounted adjacent a second, rearward end portion 20 of the housing 16. The target 18 is mounted to automatically translate forwardly and rearwardly relative to the projectile propeller 12.

The preferred embodiment of the invention illustrated is configured as a table top basketball game apparatus. A game projectile in the form of a small ball 22 is received within a concave recess 24 defined in the upper end of a catapult lever 26 included in the projectile propeller 12. The opposite end of the catapult lever 26 is hingedly attached to a catapult base 28. A coil spring 30 is installed between the lever 26 and the base 28. Normally the spring 30 biases the upper end of the catapult lever 26 away from the housing 16. The user may place a ball 22 into the recess 24 of the catapult lever 26 and depress the catapult lever 26 towards the housing. Release of the catapult lever 26 results in the catapult lever returning upwardly under the urging of the spring 30 to propel the ball 22 towards the target 18. The degree to which the catapult lever 26 is depressed controls the force with which the catapult lever 26 is urged upwardly by the coil spring 30, and thus controls the trajectory of the ball 22.

The target 18 includes a carriage 32 having a forward surface on which is mounted a backboard 34 and an open-ended basket 36. The basket 36 is configured to resemble a miniature basketball hoop and mesh basket. The carriage 32 includes a pin (not shown in FIG. 1) that projects downwardly through a longitudinal elongated slot 38 formed in the upper surface of the housing 16, as shall be described subsequently.

The housing 16 is generally formed as an inverted hollow shell, and may be molded of a thermoplastic or formed from other suitable materials. The carriage 32 projects upwardly from a generally flat carriage surface 42 defined by the rearward end portion 26 of the housing 16. The upper surface of the housing 16 defines a ball return trough 40 that slopes downwardly from the carriage surface 42 towards the forward end portion 14 of the housing. One or more balls 22 are included for propelling toward the target 18. Balls 22 that fall through the basket 36 are collected in the trough 40 for subsequent launching. Balls which miss the basket 36 are captured by the carriage 32 and a screen structure 44 that is mounted on the rearward end 20 of the housing 16 and surrounds the top, sides, and rear of the carriage 32. The captured balls then return to the forward end portion 14 of the housing 16 via the ball return trough 40.

Figure 2:
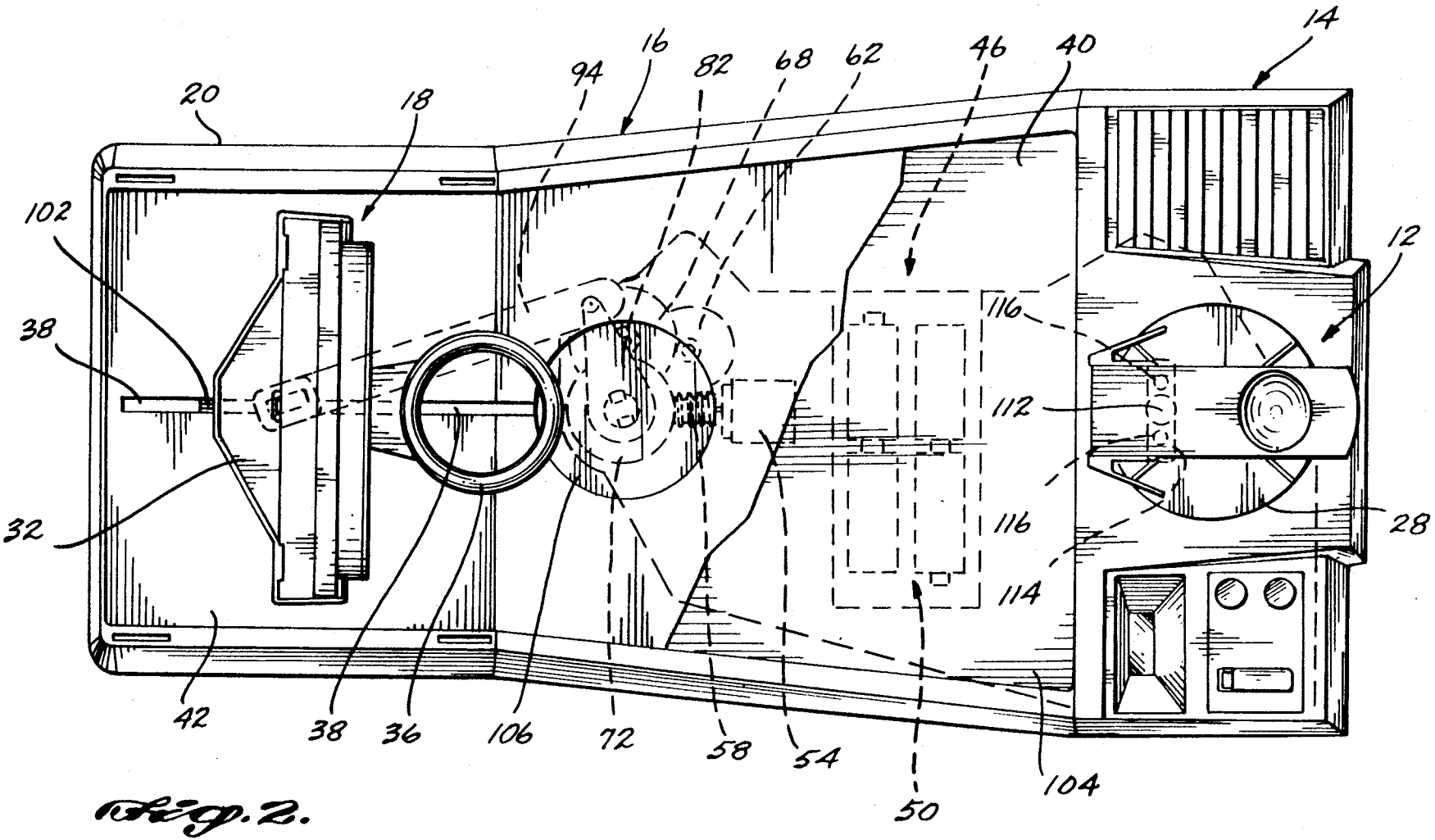
FIG. 2 shows a top elevation view of the game apparatus of FIG. 1 with a portion of the overlayment removed to show details of the construction of the housing, and showing the translation mechanism underlying the housing in dashed line.
Figure 3:
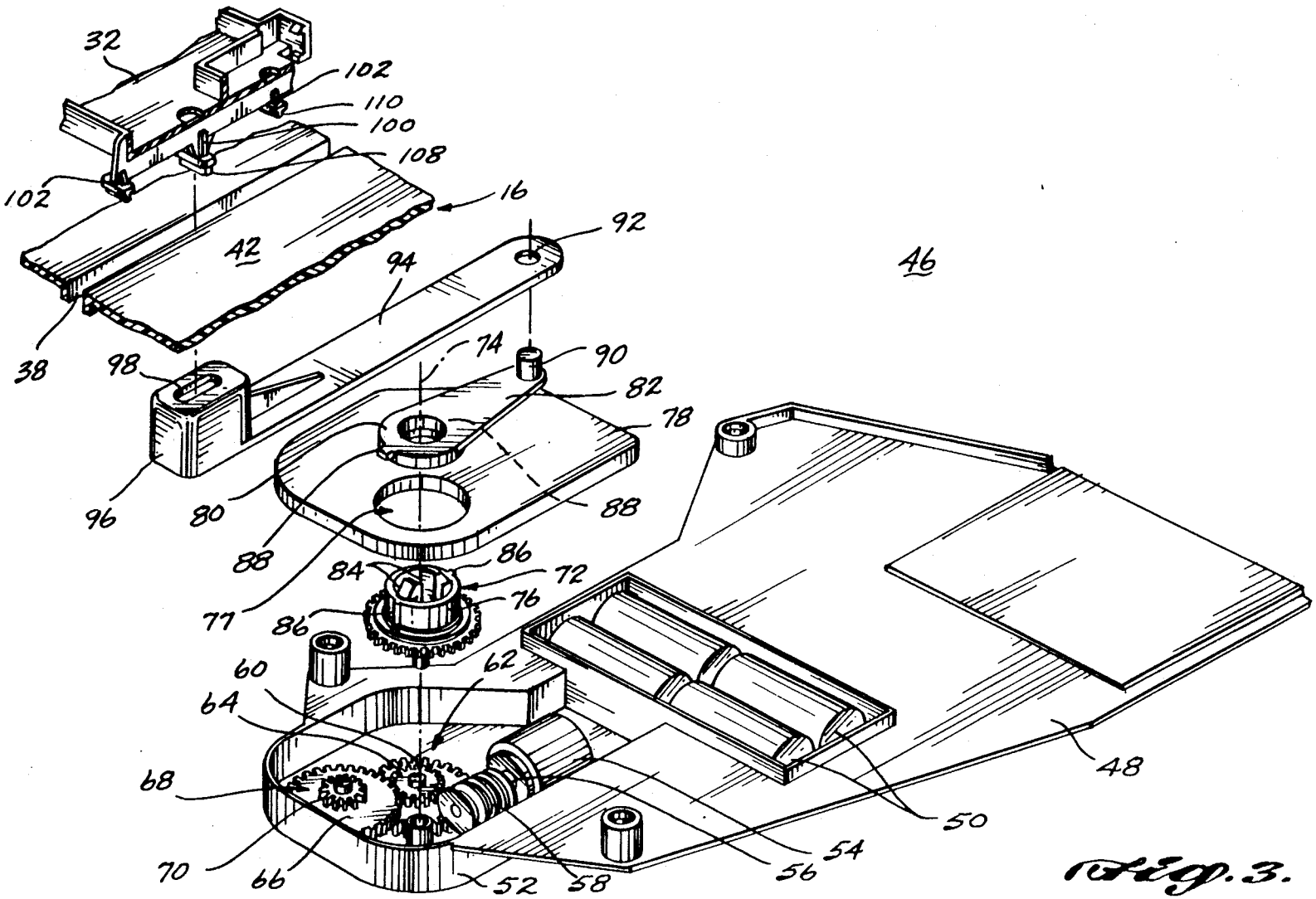
FIG. 3 shows an exploded view of the translation mechanism of the game apparatus of FIG. 1.

Reference is now had to FIGS. 2–5 for a description of a mechanism 46 for automatically translating the target 18 forwardly and rearwardly with respect to the projectile propeller 12. FIG. 2 provides a top view of the game apparatus 10 with the screen structure 44 removed for clarity. The translation mechanism 46, shown in dashed lines, is enclosed within the housing 16. Referring to FIG. 3, the translation mechanism 46 includes a base 48 that receives batteries 50 to power the apparatus. However, it should be apparent that the apparatus could be powered with alternating current rather than direct current. The base 48 defines a transmission well 52 which receives a motor 54 that is powered by the batteries 50.

A worm gear 58 is secured to a rotatable output shaft 56 projecting from the motor 54. The worm gear 58 drivingly engages a first large gear 60 of a first cluster gear 62. The first cluster gear 62 also includes a first small gear 64 that is secured axially to the first large gear 60. The first small gear 64 engages with a second large gear 66 of a second cluster gear 68. A second small gear 70 is secured axially to the second large gear 66 of the second cluster gear 68, and engages with a drive gear 72 rotatably mounted on a drive axis 74 to the base 48. An annular flange 76 formed about the drive axis 74 projects upwardly from the upper surface of the drive gear 72 through an opening 77 formed in a gear transmission cover 78. It should be apparent that other conventional gear transmission or mechanical transmissions could be used in place of the worm and cluster gear transmission described above to transmit the rotation of the motor 54 to the remaining components of the translation mechanism 46.

The hub 80 of a bell-crank 82 is nonrotatably secured to the annular flange 76 of the drive gear 72. A pair of barbed flanges 84 project upwardly from the upper surface of the drive gear 72 within the annular flange 76 and are received within an annular groove (not shown) formed on the under side of the hub 80 of the bell-crank 82. To keys 86 formed on the outer perimeter of the annular flange 76 engage with corresponding keyways 88 formed within the annular groove on the under side of the hub 80 to antirotatably secure the bell-crank 82 to the drive gear 72. Thus, rotation of the motor 54 results in rotation of the bell-crank 82 about the drive axis 74.

The bell-crank 82 includes a pin 90 projecting upwardly from the bell-crank's radially distal end. As the bell-crank rotates, the pin 90 revolves about the drive axis 74. The pin 90 is received within an opening 92 formed through one end of an elongated link member 94. An upwardly projecting hollow boss 96 is formed on the opposite end of the link member 94. An elongate slot 98 having a longitudinal axis aligned with the longitudinal axis of the elongate link member 94 is formed through the upper surface of the boss 96. The housing 16 overlies the translation mechanism 46. The carriage 32 includes a central pin 100 and two stabilizing pins 102, spaced on either side of the central pin 100, that project downwardly from the underside of the carriage 32 and are disposed along a line parallel to the longitudinal elongated slot 38 formed through the carriage surface 42.

Referring briefly to FIG. 2, the ball return trough 40 includes an overlayment 104, such as a thin sheet of flexible plastic, that is secured by adhesion or other conventional means to the top of the housing 16 within the ball return trough 40. Underneath the overlayment 104, a circular recess 106 is formed in the housing 16. The slot 38 of the carriage surface 42 extends into the circular recess 106. The carriage surface 42 and slot 38 define a carriage way on which the carriage 32 slides. To install the carriage 32 on the housing 16, the central pin 100 and stabilizing pins 102 are inserted into the circular recess 106 of the housing 16 and slid into the slot 38. Transverse bars 108 and 110 are secured to the downward ends of the pins 100 and 102, respectively, and are oriented perpendicularly with respect to the slot 38 to prevent the carriage 32 from lifting off of the carriage surface 42. The slot 38 is disposed parallel to the central longitudinal axis of the housing 16, enabling the carriage 32 to slide forwardly and rearwardly with respect to the projectile propeller 12, also disposed generally parallel to the longitudinal axis of the housing 16. The pins 100 and 102 serve to constrain the translational movement of the carriage 32 to prevent rotation of the carriage.

Referring now to FIG. 3, the pin 100 is received within the slot 98 formed in the link member 94. To install the pin 100 into the slot 98 during assembly of the game, the link member 94 is rotated so that the slot 98 is oriented parallel to the transverse bar 108 on the pin 100. The transverse bar 100 is then inserted into the slot 98 and the link member 94 is rotated 90° to effectively lock the pin 100 within the slot 98. The thickness of the pin 100 is shorter than the length of the slot 98, thus enabling the pin 100 to slide generally forwardly and rearwardly within the slot 98.

Reference is now had to FIG. 2 to explain the translational motion of the target 18 resulting from rotation of the motor 54. Rotation of the motor 54 results in rotation of the bell-crank 82 as described previously. As the bell-crank 82 rotates clockwise, as viewed in FIG. 2, toward the projectile propeller 12, the link member 94, engaged with the central pin 100 of the carriage 32, pulls the target 18 towards the projectile propeller 12. Referring to the schematic of FIG. 5, the carriage 32 is shown in the forwardmost position, wherein the target 18 is disposed in a position closest to the projectile propeller 12. In this position, the bell-crank 82 is pointing towards the projectile propeller 12, and the central pin 100 of the carriage 32 abuts the rear end of the slot 98 of the link member 94. As the bell-crank 82 rotates further clockwise, away from the projectile propeller 12, the central pin 100 slides within the slot 98 relative to the link member 94. The link member 94 is shown in dashed lines in FIG. 5, and is denoted as 94', when positioned so that it has slid relative to the central pin 100 until the pin 100 contacts the forward edge of the slot 98. During this period of sliding between the slot 98 and the pin 100, the carriage 32 is stationary, causing a delay for a fixed increment of time in the translational movement of the carriage. As the bell-crank 82 rotates still further in a clockwise direction, the link member 94 pushes against the pin 100 to translate the carriage 32 away from the projectile propeller 12 until the link member 94 is in the position shown in dashed lines and denoted at 94" in FIG. 5.

Figure 4:
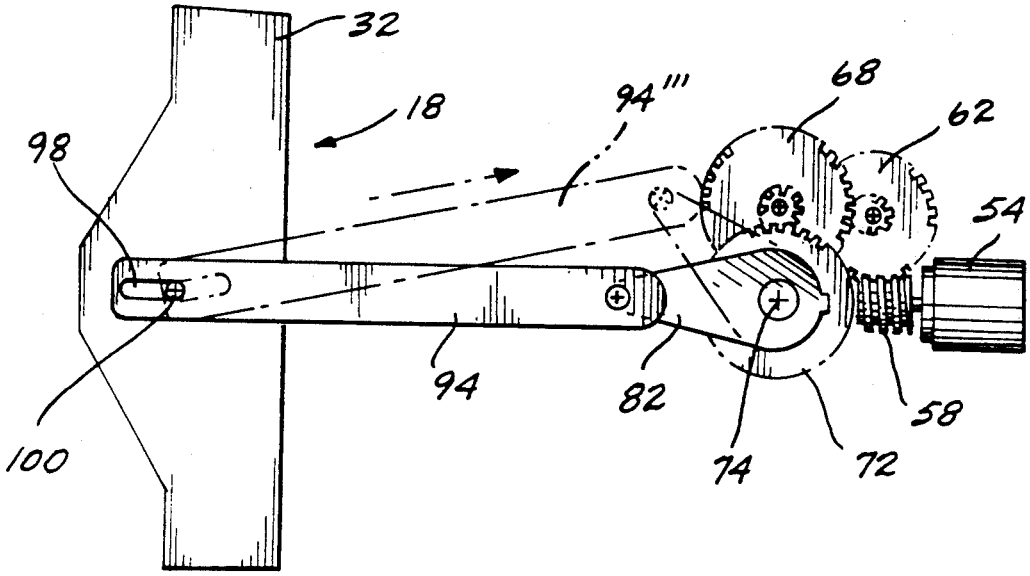
FIG. 4 shows a schematic illustration of the translation mechanism of the game apparatus of FIG. 1 positioned with the carriage in its rearmost position.
Figure 5:
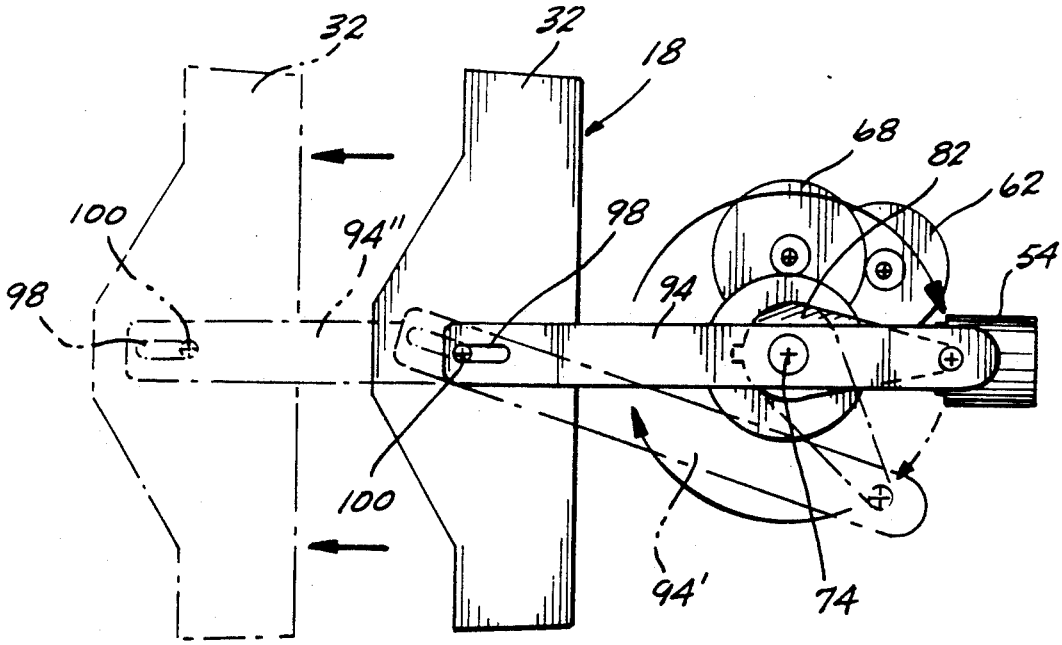
FIG. 5 provides a schematic view of the translation mechanism of FIG. 4 in its forwardmost position.

Referring now to FIG. 4, in this position the link member 94 has pushed the carriage 32 to a rearwardmost position which is furthest from the projectile propeller 12. The carriage 32 is then delayed in this rearwardmost position as the bell-crank 82 rotates further in the clockwise position, as shown in dashed lines and denoted as 94'" in FIG. 4, during which time the link member 94 slides relative to the pin 100 of the carriage 32, as constrained by the slot 98. Once pin 100 contacts the rearmost end of the slot 98, the carriage 32 is pulled in the forward translational direction.

Thus, as the bell-crank 82 rotates, the target 18 continuously translates forwardly and rearwardly with respect to the projectile propeller 12, except for delaying for a fixed increment of time in a position closest to the projectile propeller 12 (FIG. 5) and also in a position furthest from the projectile propeller 12 (FIG. 4). It should be readily apparent that this same delaying action could be achieved by including a slot on the opposite end of the link member 94 so that the link member 94 slides relative to the pin 90 of the bell-crank 82 rather than with respect to the pin 100 of the carriage 32.

Referring to FIGS. 1 and 2, as the target 18 automatically translates forwardly and rearwardly, in reciprocating fashion, during play of the game, a user is continually required to gauge the distance between the projectile propeller 12 and the basket 36. The user must adjust the degree of depression of the catapult lever 26, and thus the trajectory of the ball 22, in order to "sink" the ball 22 into the basket 36 at any given point in time. The delay in translational movement of the basket 36 at the forwardmost and rearwardmost positions further complicates this gauging of the varying position of the basket 36, and requires a higher degree of skill from the player.

Reference is now had to FIG. 2 to describe an additional aspect of the present invention. The projectile propeller 12 is mounted on a barbed pin 112 projecting downwardly from the bottom surface of the catapult base 28 through an elongate transverse slot 114 formed through the forward end portion 14 of the housing 16. Two smaller stabilizing pins 116 project downwardly on either side of the mounting pin 112 through the slot 114. The transverse distance spanned by the pins 116 is less than the transverse length of the slot 114, thus enabling the projectile propeller 12 to be slid transversely relative to the target 18 until one of the pins 116 contacts an end of the slot 114. Also, due to the reduced diameter of the stabilizing pins 116, the projectile propeller 12 may also be rotated slightly about the mounting pin 112 until the stabilizing pins 116 contact opposing long sides of the slot 114. The ability to adjust the position of the projectile propeller 12 transversely and rotatably with respect to the target 18 enables a user to adjust the angle of launch of the ball 22. This arrangement also requires a higher skill level of the user to find the proper angular and transverse position for the projectile propeller 12 relative to the translational position of the target 18, adding to the challenge of the game. It should be readily apparent that if the dimensions of the slot 114 were increased in either length or width, the ability to translate or rotate the projectile propeller 12 would increase correspondingly. Alternately, the projectile propeller 12 could be rigidly secured to the housing 16 to eliminate this variable in the trajectory of ball 22.

Referring to FIG. 1, the game apparatus 10 further includes circuitry and switches to enable monitoring and display of game play data. In the preferred embodiment illustrated, the apparatus includes a control panel 118 included on the forward end portion 14 of the housing 16. The control panel includes a power on/off switch 120 for controlling the supply of power to the motor 54. The apparatus further includes an electronic circuit including a microprocessor (not shown) disposed within the housing. A switch lever 122, extending into the basket 36 from the opposite side of the carriage 32, is tripped each time a ball 22 falls through the basket 36, activating a switch such as a pressure-sensitive switch (not shown) mounted to the backside of the carriage 32. The switch lever 122 enables the electronic circuitry to monitor the number of times the ball passes through the basket during game play. The electronic circuitry also includes a timer (not shown) for monitoring elapsed time of play.

Numerous game variations can be played on a game apparatus constructed in accordance with the present invention. For example, the control panel 118 of the game apparatus 10 is illustrated as including two game selection switches 124. A first game variant counts the number of times a ball 22 passes through the basket 36 during a specific limited period of time, and displays that data on an LCD or LED display 126 mounted within the control panel 118. A second game variation monitors the elapsed time it takes for a player to sink a specified number of balls 22 through the basket 36. Other game variations may be envisioned by those of ordinary skill in the art.

Although the preferred embodiment of the game apparatus 10 has been described configured as a miniaturized basketball game, other types of game apparatus may be constructed in accordance with the present invention to resemble other sports games. For example, a golf game apparatus could be constructed in which a propelling device operable by the player hits a ball towards a forwardly and rearwardly translating fairway surface including a cup as a target to receive the ball. As another example, a game apparatus mimicking an ice hockey game could be constructed wherein a puck would be propelled towards a forwardly and rearwardly translating goal cage.

The translation mechanism 46 embodied in the game apparatus 10 described above incorporates a bell-crank 82 and a link member 94. However, it should be readily apparent that other translation mechanisms functioning in a similar manner may be utilized in place of this mechanism to translate the carriage 32. For instance, a camplate could be rotated by the motor, with one end of a link member secured to the camplate at a point radially offset from the rotational axis of the camplate.

The game apparatus 10 described above is configured for forward and rearward translational movement of the target 18 relative to the projectile propeller 12. However, it would be possible to construct other game apparatus wherein a target automatically translates in a different pattern, such as an arcuate translational movement, and still achieve a varying distance between the target and a projectile propeller.

It would also be possible to construct a game apparatus similar to game apparatus 10, but embodying two projectile propellers and two translating targets to enable play by two players. This two-player game apparatus could be constructed by electronically connecting two separate game apparatuses 10. Alternately, two game apparatuses could be mechanically linked to form a single two-player game apparatus. For example, in place of the link member 94, a platen member connected to first and second translating carriages could be coupled to a single rotating member to translate both carriages forwardly and rearwardly at the same time. Further variations include games constructed similar to game apparatus 10, but having greater than two players. Also, a game may be constructed to include two or more projectile propellers for use by two or more players attempting to propel projectiles towards a single translating target.

The above-described game apparatus 10 includes a mechanism for delaying translation of the carriage 32 at a forwardmost and a rearwardmost position. Although this aspect of the invention makes the game more challenging, it is not necessary to the broadest aspects of the invention and a game apparatus could be constructed without this delay feature.

Finally, the game apparatus 10 has been described as embodied in a tabletop game. However, it should be readily apparent that a slightly larger version of the game apparatus could be built for use in an arcade-type setting.

The present invention has been described in relation to a preferred embodiment and several variations. One of ordinary skill after reading the foregoing specification will be able to effect various other changes, alterations, and substitutions of equivalents without departing from the broad concepts disclosed. It is therefore intended that the scope of Letters Patent granted hereon be limited only by the definition contained in the appended claims and the equivalents thereof, and not by limitations of the embodiments described thereof.

The embodiments of the invention in which an exclusive property or privilege is claimed are defined as follows:

1. A game apparatus for propelling a game projectile towards a target, comprising:

a housing defining a first end portion and a second end portion;

propelling means mounted on the first end portion of the housing for selectively propelling the game projectile towards the target;

translation means for supporting the target adjacent the second end portion of the housing to reciprocate the target along a longitudinal axis towards and away from the propelling means; and power means for powering the translation means to automatically reciprocate the target.

2. The game apparatus of claim 1 wherein:

the power means comprises a motor having an output shaft; and the translation means includes a gear transmission coupling the motor output shaft to the rotating member.

3. The game apparatus of claim 1, wherein:

the game projectile comprises a ball;

the target comprises an open ended basket; and the propelling means is operable to vary the trajectory of the ball, as it is propelled from the propelling means towards the basket, in relation to the translational position of the basket.

4. The game apparatus of claim 1, wherein the propelling means is selectively positionable transversely with respect to the translating target.

5. The game apparatus of claim 1, wherein the translation means comprises:

a rotating member coupled to the power means to rotate about a drive axis; and an elongate link member having a first end pivotally connected to the rotating member at a point spaced radially from the drive axis and having a second end coupled to the target, rotation of the rotating member resulting in translation of the target towards and away from the propelling means.

6. The game apparatus of claim 5, further comprising means for delaying translational movement of the target for a fixed increment of time at a position closest to the propelling means and at a position farthest from the propelling means.

7. The game apparatus of claim 6, wherein the means for delaying comprises a slot formed within the link member, the slot receiving a projection included on at least one of the targets and the rotating member, the projection sliding within the slot relative to the link member when the target is in the position closest to the propelling means and the position farthest from the propelling means to delay translation of the target.

8. The game apparatus of claim 7, wherein the translation means further comprises a carriage member to which the target is mounted, the carriage member sliding along a carriage way formed in the housing and including a pin projecting through an elongated slot formed in the housing into the slot formed within the link member.

9. The game apparatus of claim 1, wherein the propelling means is operable to vary the trajectory of the game projectile, as it is propelled from the propelling means towards the target, in relation to the translational position of the target.

10. The game apparatus of claim 9, wherein the propelling means comprises:

a catapult hingedly connected to and projecting outwardly away from the housing, and depressible towards the housing; and means for biasing the catapult away from the housing to propel a game projectile received by the catapult towards the target when the catapult is depressed and then subsequently released.

11. The game apparatus of claim 9, further comprising means for delaying translational movement of the target for a fixed increment of time at a position closest to the propelling means and at a position farthest from the propelling means.

12. The game apparatus of claim 1, wherein:

the game projectile comprises a ball; and the target comprises an open ended basket.

13. The game apparatus of claim 12, further comprising means for monitoring and displaying data including the number of balls passing through the basket during play of the game and the elapsed time of game play.

14. The game apparatus of claim 1, further comprising means for periodically delaying reciprocation of the target for a fixed increment of time, wherein the translation means continuously reciprocates the target except for the periodic delays.

15. A game apparatus for propelling a game projectile towards a target, comprising:

a housing defining a first end portion and a second end portion;

propelling means mounted on the first end portion of the housing for selectively propelling the game projectile towards the target;

translation means for supporting the target adjacent the second end portion of the housing to reciprocate the target along a longitudinal axis towards and away from the propelling means;

power means for powering the translation means to automatically reciprocate the target; and means for delaying translational movement of the target for a fixed increment of time at a position closest to the propelling means and at a position farthest from the propelling means.

16. A game apparatus for propelling a game projectile towards a target, comprising:

a housing defining a first end portion and a second end portion;

propelling means mounted on the first end portion of the housing for selectively propelling the game projectile towards the target; and translation means for supporting the target adjacent the second end portion of the housing to automatically vary the distance between the target and the propelling means during play of the game apparatus by reciprocating the target along a longitudinal axis towards and away from the propelling means.

17. A game apparatus for propelling a game projectile towards a target, comprising:

a housing defining a first end position and a second end position;

propelling means mounted on the first end portion of the housing for selectively propelling the game projectile towards the target;

rotary power means; and translation means supporting the target adjacent the second end portion of the housing and coupled to the rotary power means for converting rotary motion of the rotary power means into translational motion of the target along a longitudinal axis towards and away from the propelling means and for automatically reciprocating the target along the longitudinal axis.

* * * * *